US010734188B2

(12) United States Patent
Lee et al.

(10) Patent No.: US 10,734,188 B2
(45) Date of Patent: Aug. 4, 2020

(54) X-RAY TUBE FOR IMPROVING ELECTRON FOCUSING

(71) Applicant: SUNJE HI-TEK CO., LTD., Busan (KR)

(72) Inventors: Dong-Hoon Lee, Busan (KR); Sang-Hyo Kim, Busan (KR); Eun-Min Kim, Busan (KR); Sang-Bong Seo, Busan (KR); Dong-Gil Jung, Busan (KR); Sih-Wan Heo, Busan (KR); Dongkyu Seol, Busan (KR)

(73) Assignee: Sunje Hi-Tek Co., Ltd., Busan (KR)

( * ) Notice: Subject to any disclaimer, the term of this patent is extended or adjusted under 35 U.S.C. 154(b) by 297 days.

(21) Appl. No.: 15/787,273

(22) Filed: Oct. 18, 2017

(65) Prior Publication Data

US 2019/0019647 A1 Jan. 17, 2019

(30) Foreign Application Priority Data

Jul. 12, 2017 (KR) ..... 10-2017-0088209

(51) Int. Cl.
*H01J 35/06* (2006.01)
*H01J 35/14* (2006.01)
*H01J 35/18* (2006.01)

(52) U.S. Cl.
CPC ..... *H01J 35/14* (2013.01); *H01J 35/06* (2013.01); *H01J 35/066* (2019.05); *H01J 35/147* (2019.05); *H01J 35/18* (2013.01); *H01J 35/186* (2019.05)

(58) Field of Classification Search
CPC .. H01J 35/14; H01J 35/06; H01J 35/18; H01J 35/08
See application file for complete search history.

(56) References Cited

U.S. PATENT DOCUMENTS 4,400,824 A * 8/1983 Shidara ..... H01J 35/08 313/311
4,455,504 A * 6/1984 Iversen ..... H01J 35/106 313/30
5,008,912 A * 4/1991 Farrell ..... H05G 1/08 333/33

(Continued)

*Primary Examiner* — David P Porta
*Assistant Examiner* — Djura Malevic
(74) *Attorney, Agent, or Firm* — Muncy, Geissler, Olds & Lowe, P.C.

(57) ABSTRACT

Disclosed is an X-ray tube for improving electron focusing, which allows thermoelectrons emitted from a filament to efficiently reach a target of an X-ray irradiation window. To achieve this, the X-ray tube includes: a thermionic emitter configured to emit thermoelectrons by application of a negative high voltage; a focusing tube configured to focus the thermoelectrons emitted from the thermionic emitter; an X-ray irradiation window configured to irradiate X-rays outside by the thermoelectrons bombarded on a target distributed on the X-ray irradiation window, to generate the X-rays after the thermoelectrons pass through the focusing tube; a tube part including both the thermionic emitter and the focusing tube; and a housing surrounding the tube part, wherein the focusing tube and the housing are configured to have a same potential such that movement directions of the thermoelectrons are directed to the X-ray irradiation window.

10 Claims, 5 Drawing Sheets

(56) References Cited

U.S. PATENT DOCUMENTS 5,051,600 A * 9/1991 Schuetz ..... G21K 5/04 250/396 ML
5,153,900 A * 10/1992 Nomikos ..... A61N 5/1001 378/65
5,369,679 A * 11/1994 Sliski ..... A61N 5/1001 378/205
5,414,267 A * 5/1995 Wakalopulos ..... B29C 71/04 250/492.3
5,621,781 A * 4/1997 Blake ..... H01J 35/06 378/136
5,629,969 A * 5/1997 Koshishiba ..... G21K 7/00 378/138
5,751,784 A * 5/1998 Enck ..... H01J 35/30 378/119
6,015,325 A * 1/2000 Inazuru ..... H01J 35/165 228/187
6,044,130 A * 3/2000 Inazura ..... H01J 35/16 378/138
6,161,499 A * 12/2000 Sun ..... C23C 16/02 118/723 E
6,333,968 B1 * 12/2001 Whitlock ..... B82Y 10/00 378/136
6,351,520 B1 * 2/2002 Inazaru ..... H01J 5/52 378/138
6,487,272 B1 * 11/2002 Kutsuzawa ..... H01J 35/08 378/140
7,349,525 B2 * 3/2008 Morton ..... H01J 35/08 378/124
7,448,802 B2 * 11/2008 Oettinger ..... H05G 1/10 378/203
7,526,069 B2 * 4/2009 Matsumura ..... H01J 35/18 378/119
8,000,449 B2 * 8/2011 Hauttmann ..... H01J 35/06 313/310
8,139,716 B2 * 3/2012 Okunuki ..... H01J 35/065 378/122
8,295,440 B2 * 10/2012 Cho ..... H01J 35/06 378/122
8,451,974 B2 * 5/2013 Morton ..... G21K 1/025 378/57
8,472,585 B2 * 6/2013 Ogura ..... H01J 35/08 378/111
8,581,481 B1 * 11/2013 Magera ..... H01J 37/065 313/310
8,824,637 B2 * 9/2014 Morton ..... H01J 35/12 378/130
8,831,179 B2 * 9/2014 Adler ..... H01J 35/08 378/143
8,987,982 B2 * 3/2015 Magera ..... H01J 37/065 313/310
9,042,520 B2 * 5/2015 Jeong ..... H01J 35/20 378/123
9,048,059 B2 * 6/2015 Jeong ..... H01J 35/04
9,159,525 B2 * 10/2015 Yamazaki ..... H01J 35/06
9,177,754 B2 * 11/2015 Hansen ..... H01J 35/16
9,281,155 B2 * 3/2016 Ueda ..... H01J 35/18
9,281,157 B2 * 3/2016 Utsumi ..... A61B 6/40
9,420,677 B2 * 8/2016 Morton ..... H01J 1/16
9,425,021 B2 * 8/2016 Tamura ..... H01J 35/14
9,508,524 B2 * 11/2016 Yanagisawa ..... H01J 35/12
9,514,910 B2 * 12/2016 Yanagisawa ..... H01J 35/20
9,552,956 B2 * 1/2017 Yanagisawa ..... G01N 23/04
9,570,264 B2 * 2/2017 Ogura ..... H01J 35/08
9,595,415 B2 * 3/2017 Ogura ..... H01J 35/08
9,748,070 B1 * 8/2017 Wall ..... H01J 35/08
10,032,597 B2 * 7/2018 Ohashi ..... H01J 35/08
10,159,455 B2 * 12/2018 Takanaka ..... A61B 6/54
10,242,837 B2 * 3/2019 Yamada ..... H01J 35/08
10,361,057 B2 * 7/2019 Tsunoda ..... H01J 35/08
2003/0021377 A1 * 1/2003 Turner ..... G01N 23/223 378/102
2004/0022361 A1 * 2/2004 Lemaitre ..... H01J 35/06 378/138
2004/0076260 A1 * 4/2004 Charles, Jr. ..... H01J 35/08 378/124
2006/0280290 A1 * 12/2006 Matsumura ..... H01J 35/18 378/140
2007/0025516 A1 * 2/2007 Bard ..... H01J 35/14 378/138
2008/0232546 A1 * 9/2008 Stierstorfer ..... A61B 6/583 378/70
2009/0086898 A1 * 4/2009 Richardson ..... G01N 23/223 378/45
2010/0316192 A1 * 12/2010 Hauttmann ..... H01J 35/06 378/136
2012/0307974 A1 * 12/2012 Yamazaki ..... H01J 35/06 378/62
2012/0307978 A1 * 12/2012 Yamazaki ..... H01J 35/06 378/121
2013/0016810 A1 * 1/2013 Tamura ..... H01J 35/12 378/62
2013/0016811 A1 * 1/2013 Ueda ..... H05G 1/025 378/62
2013/0016812 A1 * 1/2013 Yanagisawa ..... H01J 35/16 378/62
2013/0034207 A1 * 2/2013 Aoki ..... H01J 35/04 378/62
2013/0148781 A1 * 6/2013 Yamazaki ..... H05G 1/025 378/62
2013/0230143 A1 * 9/2013 Ueda ..... H01J 35/18 378/62
2014/0056406 A1 * 2/2014 Yamazaki ..... H01J 35/04 378/62
2014/0065918 A1 * 3/2014 Magera ..... H01J 37/065 445/29
2014/0369470 A1 * 12/2014 Ukiyo ..... H01J 35/16 378/62
2016/0155598 A1 * 6/2016 Shiozawa ..... H01J 35/16 378/62

* cited by examiner

X-RAY TUBE FOR IMPROVING ELECTRON FOCUSING

CROSS-REFERENCE TO RELATED APPLICATION

The present application claims priority to Korean Patent Application No. 10-2017-0088209, filed Jul. 12, 2017, the entire contents of which is incorporated herein for all purposes by this reference.

BACKGROUND OF THE INVENTION

1. Field of the Invention

The present invention relates generally to an X-ray tube for improving electron focusing. More particularly, the present invention relates to a an X-ray tube for improving electron focusing, the X-ray tube allowing thermoelectrons emitted from a filament to efficiently reach a target of an X-ray irradiation window.

2. Description of the Related Art

In general, an X-ray tube uses a cylindrical focusing tube such that thermoelectrons emitted from a filament efficiently move to an X-ray irradiation window (or an X-ray emitter). Despite the focusing tube, the efficiency with which the thermoelectrons emitted from the filament to the target is low. Further, due to the thermoelectrons striking the target, the gaseous impurities are detached (separated) from the target and are charged with positive ions while colliding with other thermoelectrons, and the cationic impurities may adhere to the filament (a negative high voltage) disposed inside the focusing tube, which shortens the lifetime of the filament.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose an X-ray tube, which is provided with an upper focusing tube and a lower focusing tube and is configured such that a housing and the lower focusing tube have the same potential, so that thermoelectrons emitted from a filament can efficiently move to a target, and it is possible to reduce the rate at which impurities adhere to the filament.

The objectives presented by the present invention are not limited to the objectives mentioned above, and other objectives not mentioned may be clearly understood by those skilled in the art from the following description.

To achieve the object of the present invention, there is provided an X-ray tube for improving electron focusing, the X-ray tube including: a thermionic emitter configured to emit thermoelectrons by application of a negative high voltage; a focusing tube configured to focus the thermoelectrons emitted from the thermionic emitter; an X-ray irradiation window configured to irradiate X-rays outside by the thermoelectrons bombarded on a target distributed on the X-ray irradiation window, to generate the X-rays after the thermoelectrons pass through the focusing tube; a tube part including both the thermionic emitter and the focusing tube; and a housing surrounding the tube part, wherein the focusing tube and the housing are configured to have a same potential such that movement directions of the thermoelectrons are directed to the X-ray irradiation window.

Further, the thermionic emitter may include a filament, and a plurality of stem pins applying the negative high voltage to the filament; the focusing tube may include a first focusing tube surrounding the filament and firstly focusing thermoelectrons emitted from the filament, and a second focusing tube secondly focusing thermoelectrons emitted from the first focusing tube by being disposed to face the first focusing tube; and the focusing tube and the housing may be configured to have the same potential such that the movement directions of the thermoelectrons are directed from the first focusing tube to the second focusing tube.

The X-ray tube may further include: a substrate provided with first, second, and third terminals, and disposed at an end of the housing; and a connection part electrically connected to any one of the terminals of the substrate, wherein the first and second terminals are electrically connected to the plurality of stem pins, respectively, and the third terminal is electrically connected to the connection part, and first and second stem pins of the plurality of stem pins and the connection part have a same potential.

Further, the first stem pin and the connection part may be supplied with a negative high voltage to cause the thermoelectrons to be bombarded on the target, and the second stem pin may be supplied with a negative high voltage to allow the filament to emit the thermoelectrons.

Further, the connection part, the first focusing tube, and the housing may be electrically connected to each other, so that the same potential is generated with the negative high voltage.

Further, the housing, the first focusing tube, and the connection part may be made of a conductive material.

Further, the housing may be made of a brass material, both the first focusing tube and the second focusing tube may be made of a SUS material or a Kovar material, and the connection part may be made of a Kovar material.

The X-ray tube may further include: a getter disposed below the filament to maintain a vacuum inside the tube part, with the plurality of stem pins penetrating therethrough; and a stem part disposed below the getter, with the plurality of stem pins penetrating therethrough.

Further, the housing may have a predetermined length such that the first focusing tube is placed inside the housing and the second focusing tube is placed outside the housing.

Further, the tube part and the stem part may be made of a ceramic material.

Further, the first focusing tube and the second focusing tube may extend longitudinally so as to face each other while being spaced apart from each other at a predetermined interval in the tube part, and each of the first focusing tube and the second focusing tube may be provided with an opening at an end tip thereof to emit or receive thermoelectrons.

Further, the connection part may be coupled to support the stem part.

According to the present invention configured as described above, since the upper focusing tube is disposed below the X-ray irradiation window, and both the housing and the lower focusing tube have the same potential, the thermoelectrons emitted from the filament can efficiently move to the target.

Further, according to the present invention, since a negative high voltage is maintained in the housing, it is possible to reduce the rate at which impurities adhere to the filament.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE PREFERRED EMBODIMENTS

Hereinbelow, for better understanding of the invention, preferred embodiments of the present invention will be described in detail with reference to the accompanying drawings. It should be understood that the embodiment of the present invention may be changed to a variety of embodiments and the scope and spirit of the present invention are not limited to the embodiment described hereinbelow. Further, in the following description of the present invention, detailed descriptions of known functions and components incorporated herein may be omitted, and the description of these omitted components (methods) and functions can be sufficiently referred to within the scope of the technical idea of the present invention.

Figure 1:
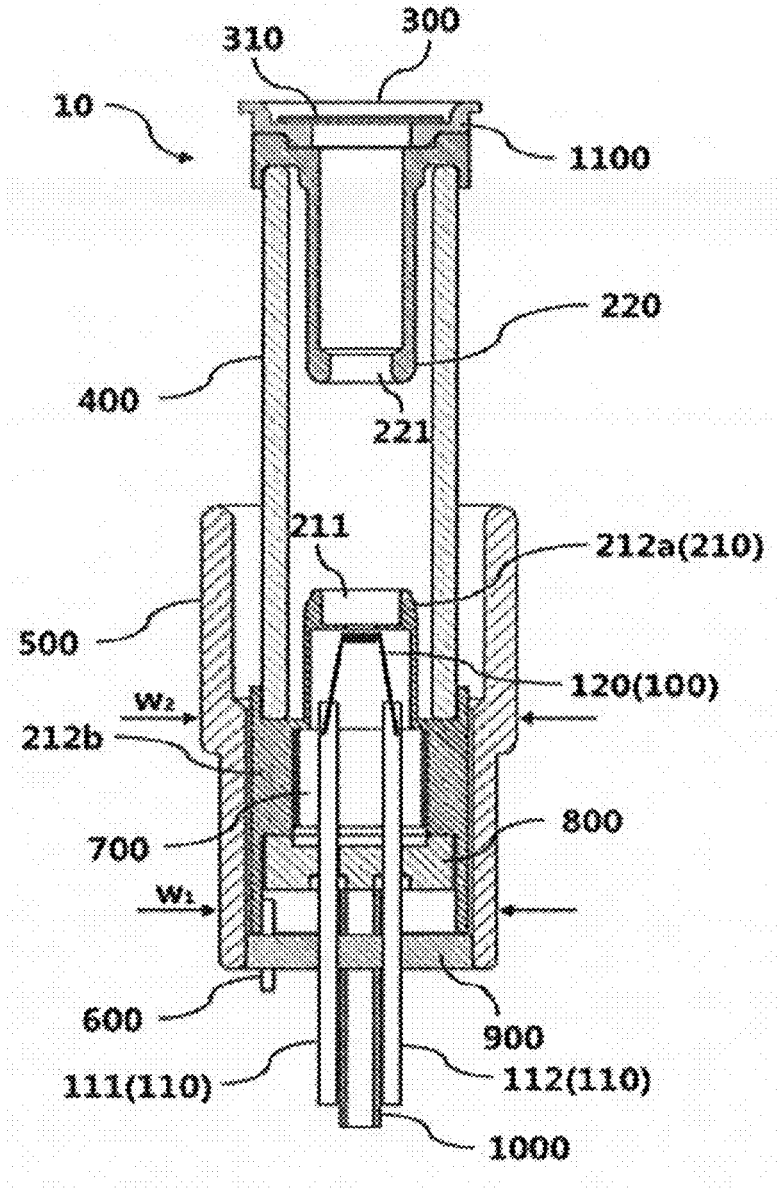
FIG. 1 is a sectional view showing an X-ray tube according to the invention.

As shown in FIG. 1, an X-ray tube for improving electron focusing according to the invention roughly includes a thermionic emitter 100, a focusing tube 200, an X-ray irradiation window 300, a tube part 400, a housing 500, a connection part 600 (or a link wire), a getter 700, a stem part 800, a substrate 900, and an exhaust tube 1000. Hereinbelow, an X-ray tube 10 for improving electron focusing according to the invention will be described in detail, with reference to the accompanying drawings.

The thermionic emitter 100 includes a plurality of stem pins 110 (or a metal wire), and a filament 120. The plurality of stem pins 110 is constituted by a first stem pin 111 and a second stem pin 112, and preferably, is made of a Fe—Ni alloy material or Kovar material. To operate the X-ray tube 10, the first stem pin 111 is applied with a negative high voltage (or a negative AC high voltage, hereinafter referred to as "negative high voltage") output from a high voltage generating part (not shown) to cause the thermoelectrons to be bombarded on a target (approximately −1 kV to −60 kV Value is applied), and the second stem pin 112 is applied with a negative high voltage such that thermoelectrons are emitted from the filament. It is preferred that the negative high voltage supplied to the first and second stem pins 111 and 112 be the same potential and be slightly different in frequency or phase from each other as AC voltage. Accordingly, the first and second stem pins 111 and 112 are individually supplied with the negative ac high voltage supplied by the high voltage generating part (the high voltage generating part generates a negative DC high voltage and then converts it back into a negative AC high voltage). The ground potential (or earth potential) is generated in an anode body 1100 or a casing (not shown). As shown in FIG. 1, the first and second stem pins 111 and 112 are electrically connected to first and second terminals 910 and 920 of the substrate 900, sequentially pass through the stem part 800 and getter 700 based on the lower portion of the tube part 400, and are electrically connected to the filament. The first and second stem pins 111 and 112 are spaced apart from each other at a predetermined interval, and pass through center areas of the stem part 800 and the getter 700. Here, it is preferred that the stem part 800 and the getter 700 be formed in a cylindrical shape to be provided in the housing 500.

The filament 120 is disposed in the center area of the tube part 400, and is longitudinally disposed from the lower end of the tube part 400 to the upper portion thereof (the direction of the X-ray irradiation window defined as the upper direction, and the direction of the substrate defined as the lower direction in FIG. 1). The metal material used for the filament may be W (tungsten), an alloy of W and Re (rhenium), an alloy of W and ThO2 (thorium dioxide), or the like. Considering the durability of the filament and the thermoelectron emission efficiency, it is preferable to use other materials (including materials not described in the present invention) depending on the environment of use.

The focusing tube 200 is configured such that based on a longitudinal direction of the tube part 400, a first focusing tube 210 (a lower focusing tube) is disposed at the lower portion, and a second focusing tube 220 (an upper focusing tube) is disposed at the upper portion. The focusing tube 200 is made of a conductive metal material (for example, SUS material), and preferably, is formed in a cylindrical shape. The first focusing tube 210 is disposed at the lower portion of the tube part 400 to accommodate the filament 120 therein. Thereby, the first focusing tube 210 firstly focuses thermoelectrons emitted from the filament 120. The second focusing tube 220 is provided below the X-ray irradiation window 300 at the upper portion of the tube part 400 to correspond to the first focusing tube 210, and secondly focuses thermoelectrons emitted from the first focusing tube 210. The first and second focusing tubes 210 and 220 are provided inside the tube part 400, and are disposed to be spaced apart from each other at a predetermined interval in the longitudinal direction. The interval may be determined considering lengths of the tube part 400 and the housing 500, and the thermoelectron focusing efficiency. The longitudinal length of the second focusing tube 220 may be longer than the length of the first focusing tube 210, and a width (or a diameter) thereof may be the same as or smaller than that of the first focusing tube. End tips of the first and second focusing tubes 210 and 220 are provided with openings 211 and 221, respectively, to emit or receive thermoelectrons. It is preferred that a diameter of the opening 211 of the first focusing tube be greater than that of the opening 221 of the first focusing tube.

A first body 212*a* disposed in a first area of the first focusing tube 210 is arranged to surround the filament 120, and is formed at an end of the opening 211. A second body 212*b* disposed in a second area of the first focusing tube 2 is arranged such that the getter 700 and the stem part 800 are disposed therein. Further, a rear end of the second body 212*b* is disposed to be in contact with an upper surface of the substrate 900. Meanwhile, a rear end portion of the second body 212*b* is disposed to be electrically connected to the inner wall of the housing 500 and the connection part 600. Accordingly as described hereinbelow, the housing 500, the first focusing tube 210, and the connection part 600 can be maintained to have the same potential.

A target 310 is distributed on the X-ray irradiation window 300, with the thermoelectrons secondly focused in the second focusing tube 220 bombarded thereon, X-rays (preferably, soft X-rays) are generated by the bombardment of the thermoelectrons against the target, and the X-rays are irradiated outside through the X-ray irradiation window 300. As shown in FIG. 1, the second focusing tube 220 is coupled to the upper end of the tube part 400, and X-ray irradiation window 300 is coupled to the second focusing tube 220. The X-ray irradiation window 300 is constituted by the target of Be (beryllium) and tungsten metal.

The tube part 400 is made of non-conductive ceramic material and is in a hollow cylindrical shape. In the tube part 400, the filament 120 and the first and second focusing tubes 210 and 220 are provided. The tube part 400 is in a cylindrical shape, and has a predetermined length and a diameter in the longitudinal direction. The diameter of the tube part 400 is determined to such that the filament 120 and the first and second focusing tubes 210 and 220 are placed inside the tube part while being spaced from each other at an interval. Since the tube part 400 is made of a ceramic material, the strength is greater than that of the conventional one of a glass material.

The housing 500 is made of brass material, and is in a cylindrical shape with the tube part 400 disposed therein. However, the housing 500 has different diameters in the longitudinal direction, as shown in FIG. 1. In other words, it is preferred that a diameter w1 from the substrate 900 approximately to the getter 700 (the first area) be smaller than a diameter w2 of an area over the getter 700 (the second area). Accordingly, the housing 500 is formed to have a step (the first area and the second area formed to have different diameters). Further, it is preferred that the housing 500 have a length that allows the substrate 900 and the first focusing tube 210 provided at the lower end of the housing 500 to be accommodated therein. It is more preferable to have a longer length than the length that allows the substrate 900 and the first focusing tube 210 to be accommodated therein. Thereby, as shown in FIG. 1, the length of the housing 500 is preferably formed to be a length that is slightly shorter than the approximate middle length of the tube part 400. In other words, it is preferred that the length of the housing 500 be formed to accommodate 30 to 50% of the length of the tube part 400 inside the housing. The tube part 400 is disposed in the housing 500 while being spaced apart from the housing at a predetermined interval.

Figure 2:
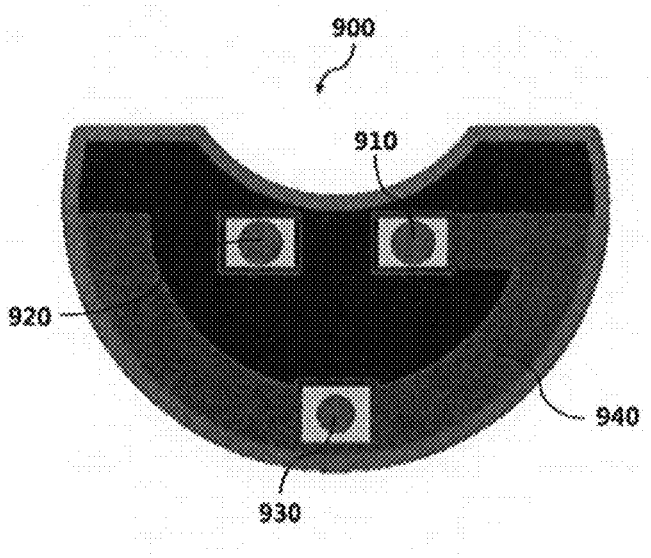
FIG. 2 is a view showing first, second, and third terminals of a substrate of the present invention.

As shown in FIGS. 1 and 2, the connection part 600 (the link wire) are electrically connected to a third terminal 930 of the substrate 900. The third terminal 930 has the same potential as the first terminal 910, and is applied with a negative high voltage. Accordingly, the connection part 600 is supplied with the negative high voltage. Further, the connection part 600 is electrically connected to the lower inner wall of the first focusing tube 210, and the lower outer wall of the first focusing tube 210 is electrically connected to the lower inner wall of the housing 500. Accordingly, when the negative high voltage is applied to the connection part 600, the same negative high voltage is applied to the first focusing tube 210 and the housing 500, the same potential is generated. The connection part 600 is disposed in the longitudinal direction by passing through the third terminal 930 of the substrate 900, and is disposed below the stem part 800. The connection part 600 may be coupled to support the stem part 800, and preferably, is made of Kovar material of a conductive material.

As shown in FIG. 2, the first, second, and third terminals 910, 920, and 930 are formed on the substrate 900, and the substrate 900 is provided at the lower end of the housing 500. Here, the terminals means connection terminals formed on a PCB. The first terminal 910 and the second terminal 920 are electrically connected to the first and second stem pins 111 and 112, respectively, by being penetrated therethrough. The third terminal 930 is electrically connected with the connection part 600. Since the first terminal 910 and the third terminal 930 are electrically connected to each other by a potential pad 940, the negative AC high voltage as the same potential is supplied. Further, the negative AC high voltage is supplied to the second terminal 920 while the second terminal has the same potential as the first and third terminals 910 and 930; and the first and third terminals and the second terminal are supplied with different negative ac high voltages (different in frequency or phase) from each other.

The getter 700 is disposed below the filament 120 to maintain a vacuum inside the tube part 400.

The stem part 800 is disposed below the getter 700, and is arranged to be fitted in a diameter of a groove formed at the lower end portion of the second body 212*b* of the first focusing tube 210. The first and second stem pins 111 and 112 penetrate through the stem part 800 and the getter 700, and are electrically connected to opposite ends of the filament 120, respectively. Since the stem part 800 is made of a ceramic material, the first and second stem pins 111 and 112 are electrically insulated from each other, and the strength thereof is greater than the conventional one of a glass material and it does not break easily. Further, it can be manufactured smaller than that of a glass material. In the case of the conventional glass stem part, the voltage is higher than the negative high voltage, and thus, it is preferred that the stem part 800 and the tube part 400 be made of a ceramic material.

The exhaust tube 1000 is provided as in FIG. 1, for vacuum measurement of the getter 700. In other words, the exhaust tube 1000 is connected to external equipment to measure the degree of vacuum of the getter 700 from the outside and to adjust the vacuum value of the getter 700 if necessary. The exhaust tube 1000 is preferably made of Ni (nickel) or a brass material.

<Supplying Negative High Voltage to the Housing and the First Focusing Tube>

Meanwhile, the present invention is configured such that when a negative high voltage is applied to the connection part 600, a negative high voltage is also formed in the first focusing tube 210 and the housing 500 by electrical contact or conduction with the connection part 600. Here, the first focusing tube 210 is supplied with the negative high voltage by being electrically connected with the connection part 600, and the housing 500 may form the same potential as the first focusing tube 210 by electrical contact or conduction with the connection part 600, or by supplying a separate negative high voltage individually to the housing 500 (accordingly, an additional supply terminal can be electrically coupled to the housing), the same potential as the first focusing tube 210 can be formed. Accordingly, the same potential (the negative high voltage) is maintained in the first focusing tube 210 and the housing 500. The technical features of the present invention have the following two advantages Generally, due to the thermoelectrons striking the target, the gaseous impurities are detached (separated) from the target and are charged with positive ions while colliding with other thermoelectrons, and the cationic impurities adhere to the filament (a negative high voltage) disposed inside the first focusing tube 210, which shortens the lifetime of the filament. Accordingly, in the present invention, since a negative high voltage is maintained in the housing 500, some of the cationic impurities adhere to the inner wall of the tube part 400 in contact with the housing. Accordingly, the amount of impurities adhering to the filament 120 can be reduced, so that it is possible to improve the lifetime of the filament 120.

Figure 3:
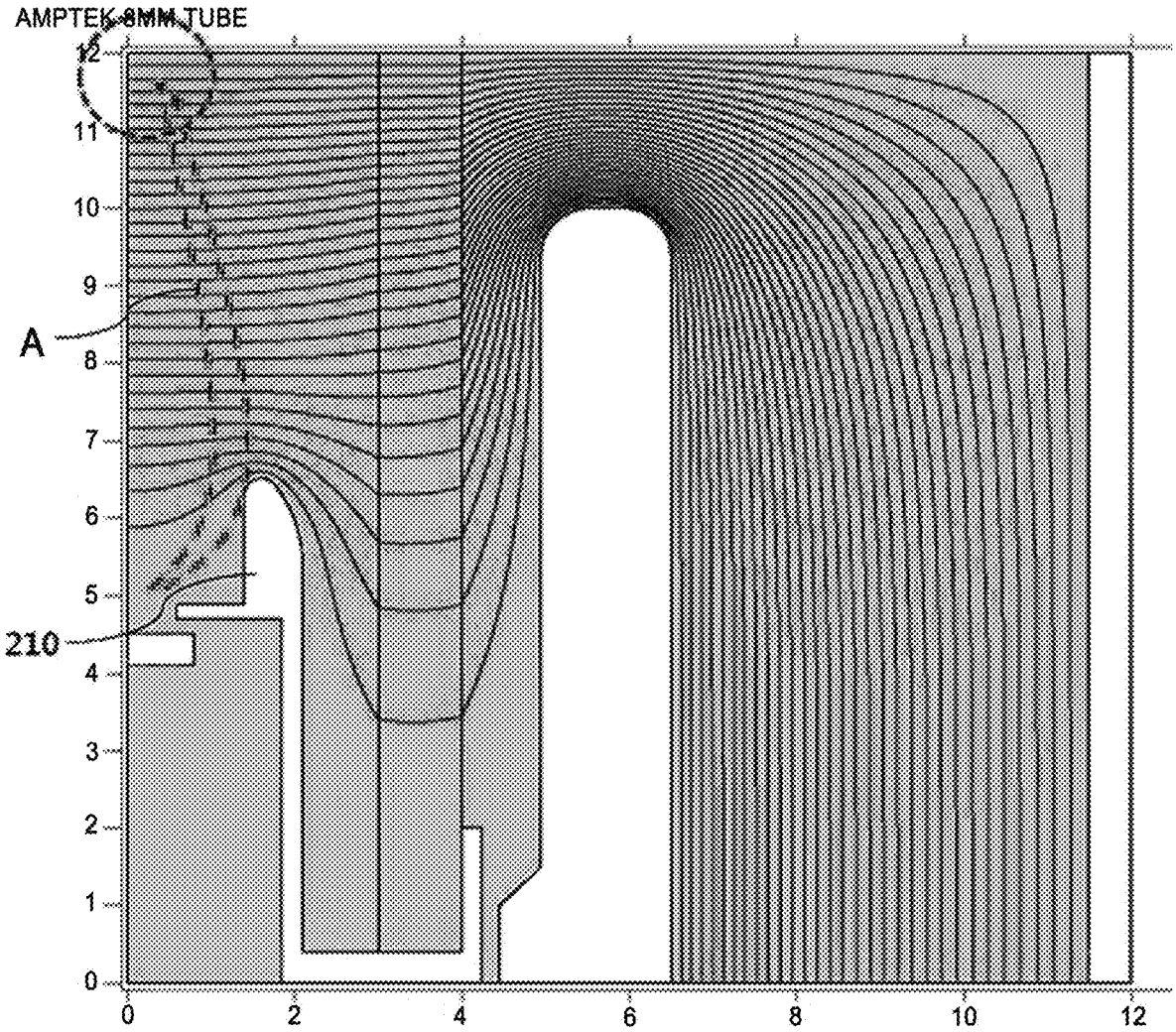
FIG. 3 is a view showing movement directions of electrons directed from a lower focusing tube to an upper focusing tube when the same potential is maintained in a housing and the lower focusing tube of the present invention.
Figure 4:
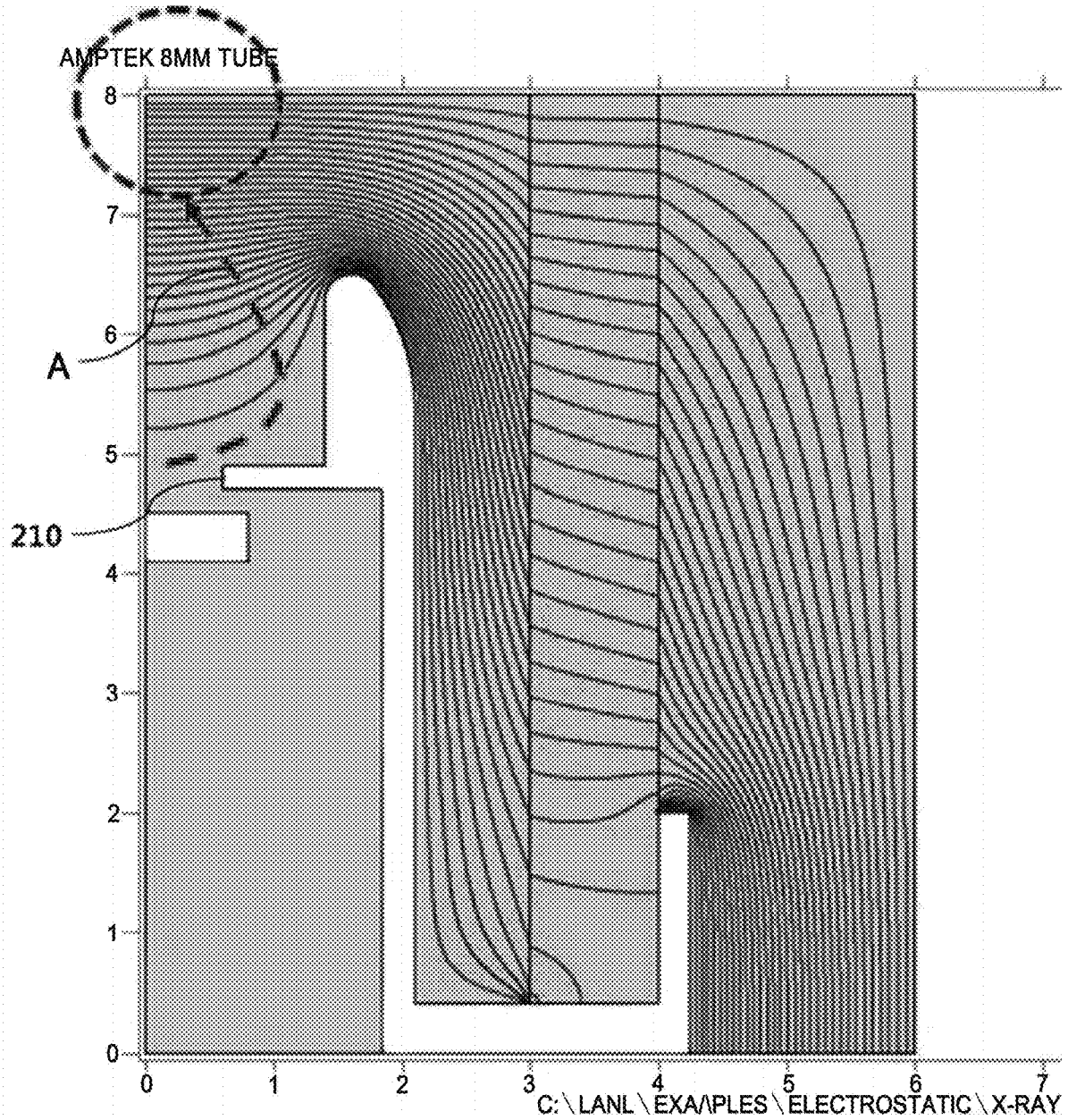
FIG. 4 is a view showing movement directions of electrons directed from the lower focusing tube to the upper focusing tube when the housing of the present invention is not provided.

Further, when a negative high voltage is applied to the connection part 600, a negative high voltage is equally applied to the housing 500 and the first focusing tube 210, so that the housing 500 and the first focusing tube 210 form the same potential. Since the housing 500 and the first focusing tube 210 form the same potential, as shown in FIGS. 3 and 4, it is possible to remarkably increase the rate at which the thermoelectrons firstly focused and emitted from the first focusing tube 210 enter the second focusing tube 220. In other words, the housing 500 and the first focusing tube 210 form the same potential, such that the movement directions of the thermoelectrons emitted from the first focusing tube 210 are directed to the second focusing tube 220.

FIGS. 3 and 4 shows movement directions A of thermoelectrons in which the thermoelectrons emitted from the first focusing tube 210 are directed to the second focusing tube 220 (that is, dotted circular areas in FIGS. 3 and 4 are the areas where the first focusing tube is disposed). Here, it can be seen that the thermoelectrons of FIG. 3 are directed more toward the second focusing tube 220 than those of FIG. 4. In other words, FIG. 4 shows that the thermoelectrons emitted from the first focusing tube do not move to the first focusing tube but move to another. The unit of coordinate axes (x-axis and y-axis) shown in FIGS. 3 and 4 is a length unit, for example, [mm].

Figure 5:
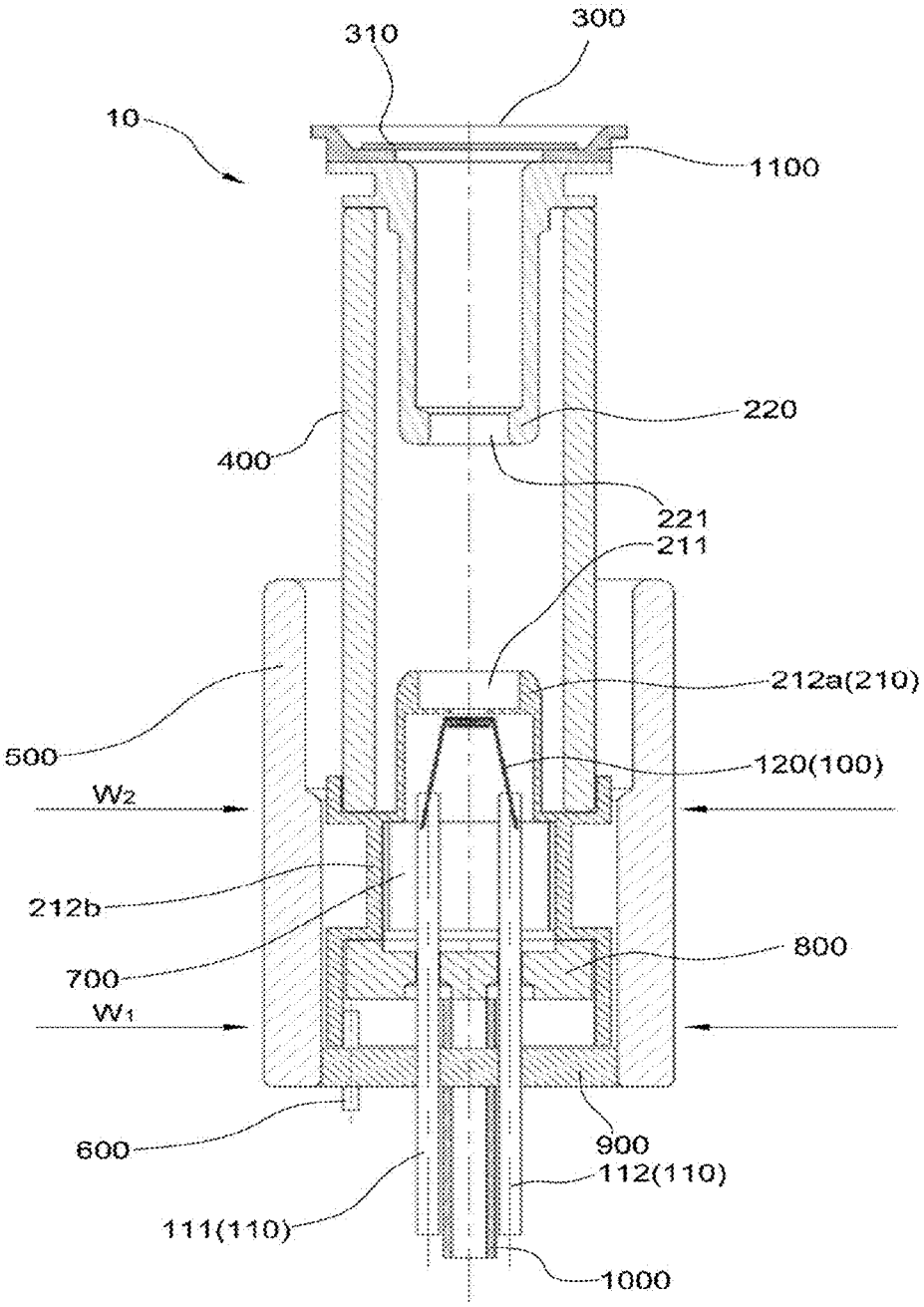
FIG. 5 is a sectional view showing a modification of the X-ray tube according to the invention.

As shown in FIG. 5, the second focusing tube 220 is configured such that a part of its outer surface is incised or recessed. This is to reduce the influence of difference in thermal expansion between the two metals by making the thickness of the brazing joint thinner and widening the contact surface in order to reduce the defects of the product in manufacturing the X-ray tube. In other words, the better the joining than the technique of FIGS. 1 to 4, the better the vacuum maintenance required for the X-ray tube. Failure to maintain the vacuum properly causes disconnection of the main filament.

In the description of the present invention, detailed descriptions of known functions and components incorporated herein may be omitted, and the description of these omitted components (methods) and functions can be sufficiently referred to within the scope of the technical idea of the present invention.

The configuration and functions of the above-described components have been described separately for convenience of explanation, and any of the components and functions may be integrated into other components or may be further subdivided.

It should be understood that the exemplary embodiments according to the concept of the present invention are not limited to the embodiments which has been described hereinbefore, but various modifications, equivalents, additions and substitutions are possible, without departing from the scope and spirit of the invention. Further, in the above description, it is to be noted that, when the functions of conventional elements and the detailed description of elements related with the present invention may make the gist of the present invention unclear, a detailed description of those elements is omitted.

What is claimed is:

1. An X-ray tube for improving electron focusing, the X-ray tube comprising:

a thermionic emitter configured to emit thermoelectrons by application of a negative high voltage;

a focusing tube configured to focus the thermo electrons emitted from the thermionic emitter;

an X-ray irradiation window configured to irradiate X-rays outside by the thermoelectrons bombarded on a target distributed on the X-ray irradiation window, to generate the X-rays after the thermoelectrons pass through the focusing tube;

a tube part including both the thermionic emitter and the focusing tube; and a housing surrounding the tube part, wherein the thermionic emitter includes a filament, and a plurality of stem pins applying the negative high voltage to the filament, the focusing tube includes a first focusing tube surrounding the filament and firstly focusing thermoelectrons emitted from the filament, and a second focusing tube secondly focusing thermoelectrons emitted from the first focusing tube by being disposed to face the first focusing tube, and wherein the focusing tube and the housing are configured to have a same potential such that movement directions of the thermoelectrons are directed from the first focusing tube to the second focusing tube towards the X-ray irradiation window, and the housing has a predetermined length such that the first focusing tube is placed inside the housing and the second focusing tube is placed outside the housing.

2. The X-ray tube of claim 1, further comprising:

a substrate provided with first, second, and third terminals, and disposed at an end of the housing; and a connection part electrically connected to any one of the terminals of the substrate, wherein the first and second terminals are electrically connected to the plurality of stem pins, respectively, and the third terminal is electrically connected to the connection part, and first and second stem pins of the plurality of stem pins and the connection part have a same potential.

3. The X-ray tube of claim 2, wherein the first stem pin and the connection part are supplied with the negative high voltage to cause the thermoelectrons to be bombarded on the target, and the second stem pin is supplied with the negative high voltage to allow the filament to emit the thermoelectrons.

4. The X-ray tube of claim 3, wherein the connection part, the first focusing tube, and the housing are electrically connected to each other, so that the same potential is generated with the negative high voltage.

5. The X-ray tube of claim 3, further comprising:

a getter disposed below the filament to maintain a vacuum inside the tube part, with the plurality of stem pins penetrating therethrough; and a stem part disposed below the getter, with the plurality of stem pins penetrating therethrough.

6. The X-ray tube of claim 5, wherein the tube part and the stem part are made of a ceramic material.

7. The X-ray tube of claim 5, wherein the connection part is coupled to support the stem part.

8. The X-ray tube of claim 2, wherein the housing, the first focusing tube, and the connection part are made of a conductive material.

9. The X-ray tube of claim 8, wherein the housing is made of a brass material, and both the first focusing tube and the connection part are made of a Kovar material.

10. The X-ray tube of claim 1, wherein the first focusing tube and the second focusing tube extend longitudinally so as to face each other while being spaced apart from each other at a predetermined interval in the tube part, and each of the first focusing tube and the second focusing tube is provided with an opening at an end tip thereof to emit or receive thermoelectrons.

* * * * *